US007434514B2

(12) United States Patent
Renaud-Bezot et al.

(10) Patent No.: US 7,434,514 B2
(45) Date of Patent: Oct. 14, 2008

(54) IGNITION DEVICE FOR EXPLOSIVE CHARGE OR PYROTECHNIC COMPOSITION

(75) Inventors: Jean-Luc Renaud-Bezot, Vornay (FR); Jerome Loison, Bourges (FR)

(73) Assignee: Giat Industries, Versailles (FR)

( * ) Notice: Subject to any disclaimer, the term of this patent is extended or adjusted under 35 U.S.C. 154(b) by 71 days.

(21) Appl. No.: 11/295,483

(22) Filed: Dec. 7, 2005

(65) Prior Publication Data

US 2008/0092764 A1 Apr. 24, 2008

(30) Foreign Application Priority Data

Dec. 16, 2004 (FR) ..... 04 13471

(51) Int. Cl.
*F42C 19/12* (2006.01)
*F42B 1/02* (2006.01)
*F42B 12/02* (2006.01)

(52) U.S. Cl. ..... 102/202.7; 102/306; 102/476

(58) Field of Classification Search ..... 102/306, 102/307, 485, 476, 202.7, 475; *F42B 1/02, F42B 1/032; F42C 19/095*
See application file for complete search history.

(56) References Cited

U.S. PATENT DOCUMENTS 3,443,518 A * 5/1969 Cross ..... 102/306
3,472,165 A * 10/1969 Null ..... 102/475
3,598,051 A 8/1971 Avery ..... 102/23
3,695,178 A 10/1972 Betts ..... 102/28 R
3,703,865 A * 11/1972 Gilbertson et al. ..... 102/475
3,877,376 A 4/1975 Kupelian ..... 102/67
3,995,574 A * 12/1976 Drimmer ..... 114/20.1
4,026,213 A 5/1977 Kempton ..... 102/56 SC
4,862,804 A * 9/1989 Chawla et al. ..... 102/309
4,982,667 A * 1/1991 Weimann ..... 102/476
5,182,418 A 1/1993 Talley ..... 102/475
5,450,794 A * 9/1995 Drimmer ..... 102/309
5,723,811 A 3/1998 Bouet et al. ..... 102/476
5,939,663 A 8/1999 Walters et al. ..... 102/476
6,393,991 B1 * 5/2002 Funston et al. ..... 102/476
2003/0033951 A1 * 2/2003 Gerard et al. ..... 102/202.7

FOREIGN PATENT DOCUMENTS

FR 2 704 052 10/1994

* cited by examiner

*Primary Examiner*—Bret Hayes
(74) *Attorney, Agent, or Firm*—Steptoe & Johnson LLP

(57) ABSTRACT

The invention relates to an ignition device for an explosive charge or pyrotechnic composition. This device comprises at least two ignition means connected to a power source. It is characterized in that it comprises a single insulating support carrying the ignition means as well as the conductors ensuring their connection to the power source.

11 Claims, 5 Drawing Sheets

IGNITION DEVICE FOR EXPLOSIVE CHARGE OR PYROTECHNIC COMPOSITION

BACKGROUND OF THE INVENTION

1. Field of the Invention

The technical scope of the invention is that of devices enabling the ignition of an explosive charge or pyrotechnic composition.

2. Description of the Related Art

Known devices are implemented namely to ignite the explosive charges in splinter-generating warheads or shaped charges (generating a dart or slug). Similarly, in splinter-generating charges, it is sometimes necessary for an angular sector to be ignited so as to orient the cone. This angular sector depends on the focusing required.

Generally speaking, ignition devices implement at least one ignition component such as a detonator or squib. These components are well known to somebody skilled in the art. According to the technology used they comprise, for example, a hot wire, a resistor bridge or semiconductor bridge (known as an SCB) which communicates energy to a flame-producing or detonating pyrotechnic composition when an electrical current passes through it.

Today, within the field of warheads, multi-mode heads are very much sought after, that is to say those able to generate splinters, a shaped charge jet or explosively-formed slug according to operational requirements.

U.S. Pat. No. 5,939,663 thus describes a multi-function head whose ignition device comprises an axial detonator and a crown of peripheral detonators. All the detonators are connected to ignition means by separate wire connections. Depending on the detonators activated, a coherent dart or projection of splinters is obtained.

The ignition device thus defined is both complicated and costly to implement since it requires the assembly of the different detonators onto a support that must be precisely positioned with respect to the charge to ensure the desired effect.

It is also axially cumbersome and requires a wire connection to be made which is also cumbersome.

SUMMARY OF THE INVENTION

The aim of the invention is to propose an ignition device able to overcome such drawbacks.

Thus, the ignition device according to the invention is both compact and inexpensive to produce. It may be adapted to different types of explosive charges and enables the ignition of an explosive charge according to different modes of operation to be reliably ensured.

The scope of application of the invention is not limited to multi-mode explosive warheads. The device according to the invention may, in fact, also be used to ignite a pyrotechnic composition, for example a gas-generating composition having several operating regimes (for example, a gas generator comprising several gas cartridges able to be ignited selectively).

Thus, the invention relates to an ignition device for an explosive charge or pyrotechnic composition, such device comprising at least two ignition means connected to a power source, such device wherein it comprises a single insulating support carrying the ignition means as well as the conductors ensuring their connection to the power source.

According to a particular embodiment, the ignition means incorporate at least one semiconductor bridge.

The ignition device according to the invention may comprise a first group of ignition means spaced over a peripheral crown.

It may also advantageously comprise a second group of ignition means spaced over at least one diametral arm.

In particular, the device may thus comprise ignition means spaced over a peripheral crown and over two orthogonal diametral arms.

All the ignition means will advantageously comprise a first contact stud connected to a common conductor.

The device may comprise at least two other control conductors, in addition to the common conductor, which will each be connected to second contact studs of two groups of separate ignition means.

The device may comprise at least a first control conductor ensuring the ignition of an axial ignition means.

It may also comprise at least a second control conductor ensuring the ignition of a first crown of ignition means spaced on arms around the axial ignition means.

It may also comprise at least a third control conductor ensuring the ignition of a sector of ignition means of the peripheral crown.

The peripheral crown may, for example, comprise four sectors of ignition means, each able to be ignited separately by specific control conductors.

BRIEF DESCRIPTION OF THE DRAWINGS

The invention will become more apparent from the following description of the different embodiments, such description being made with reference to the appended drawings, in which.

DETAILED DESCRIPTION OF PREFERRED EMBODIMENTS

Figure 1:
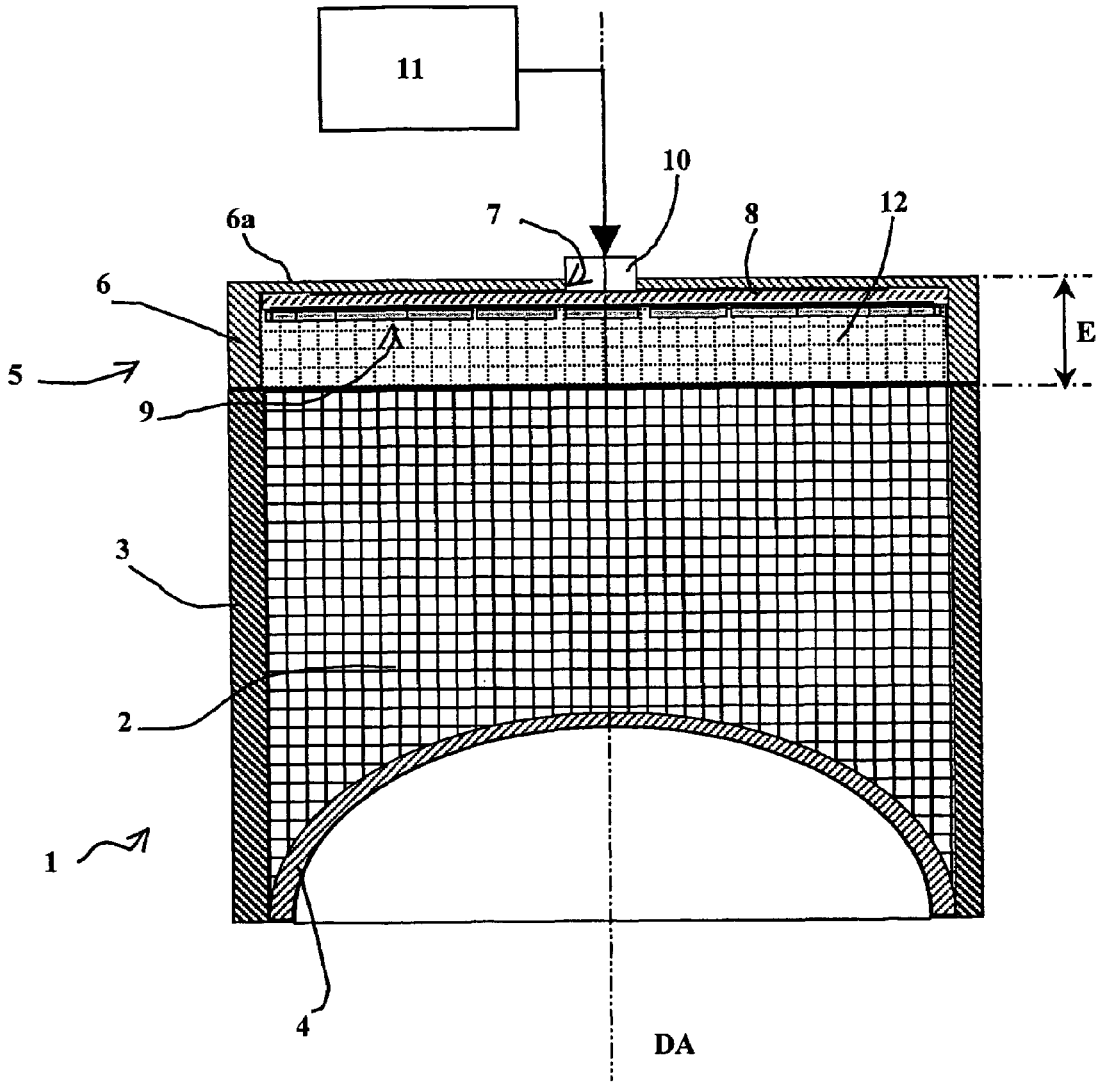
FIG. 1 shows a longitudinal section of a multi-mode warhead implementing an ignition device according to the invention.

With reference to FIG. 1, a shaped charge warhead 1 comprises an explosive load 2 placed in a cylindrical casing 3. A concave liner 4 is applied against the explosive load 2.

The demonic properties of the explosive and the geometry of the liner 4 are selected so that this warhead can have several different modes of operation according to the mode of ignition selected. These properties are well known to the Expert and will not be described here since they are not the subject of the present invention. By way of example, reference may be made to patent EP1164348 which describes such a multi-function warhead.

The warhead 1 may be ignited by an ignition device 5. The latter comprises a cylindrical case 6 having substantially the same external diameter as the casing 3 of the warhead 1 and closed by a flat bottom 6*a* in which an axial opening 7 is made.

In accordance with the invention, the case 6 encloses a single insulating support 8 carrying the ignition means 9. A connector 10 is fastened at a rear face of the support 8 which allows the ignition device 5 to be connected to electronic control means 11 incorporating a power source enabling the ignition device 5 to be activated. The connector 10 comes out of the case via the opening 7.

The case 6 also encloses a detonating pyrotechnic composition 12, for example compressed hexanitrostilben (HNS) or cyclonite (RDX), which is applied by compression against the support 8. A sheet of plastic explosive, for example an explosive based on rubber and pentrite (known as Formex) may be used for the composition 12.

The case 6 is fastened to the casing 3 by linking means, not shown here, for example by an external ring screwed or crimped both onto the case 6 and the casing 3 so that the warhead 1 and ignition device 5 may form a single component.

Figure 2:
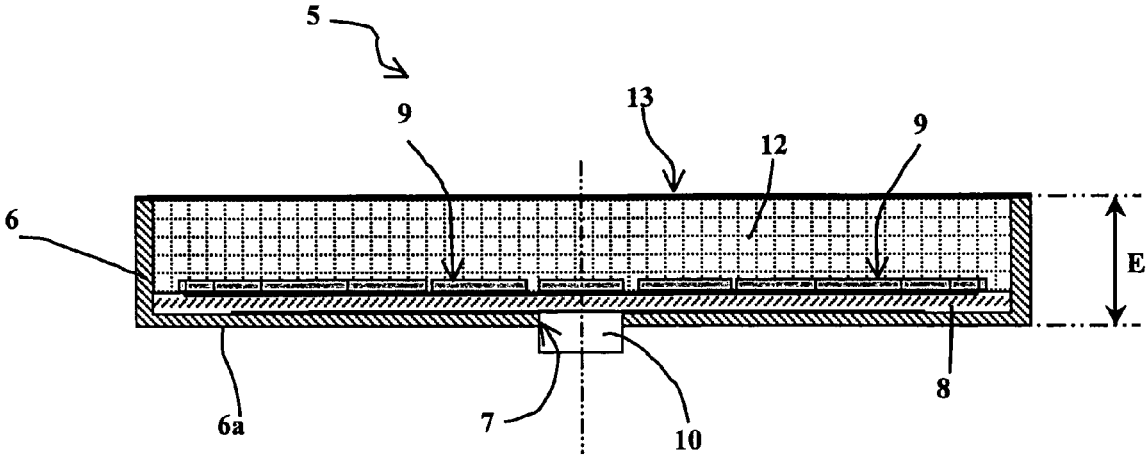
FIG. 2 is a longitudinal section of an embodiment of the ignition device alone.

Furthermore, as may be more particularly seen in FIG. 2, a thin sealing fail 13, for example of aluminum, will be applied to the face of the detonating composition 12 intended to come into contact with the explosive load 2. This fail will ensure a sealing function when the ignition device 5 is being stored separately from a warhead 1.

Figure 4:
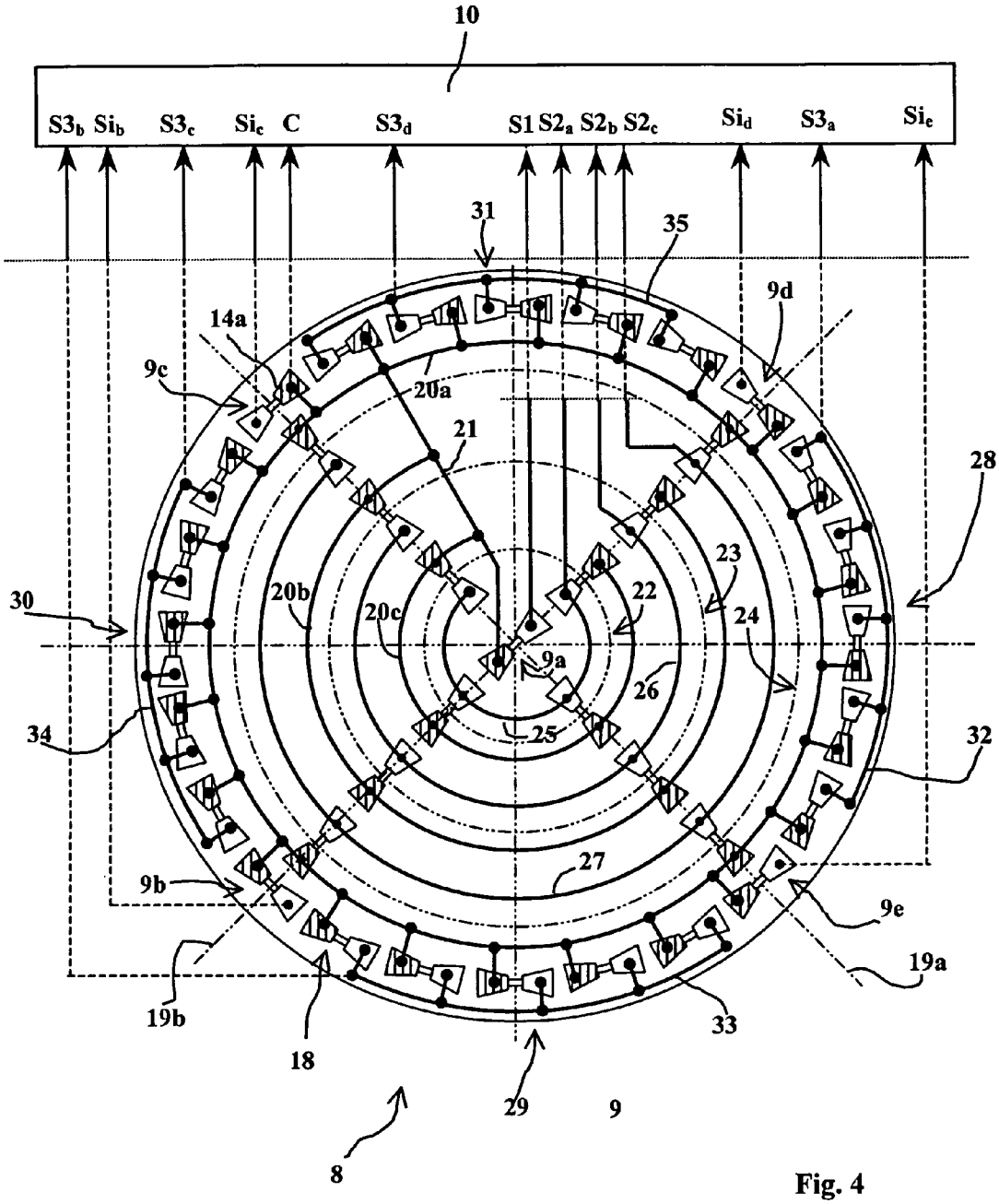
FIG. 4 is a top view of the support carrying the different ignition means elements.

The support 8 may be more particularly seen in FIG. 4. It is made of an insulating material and carries ignition means 9 on one of its surfaces intended to come into contact with the detonating composition 12.

Figure 3A:
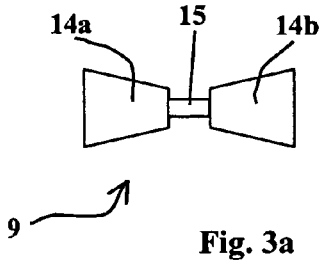
FIG. 3*a* is a schematic view of a semiconductor bridge element implemented in one embodiment of the device according to the invention.
Figure 3B:
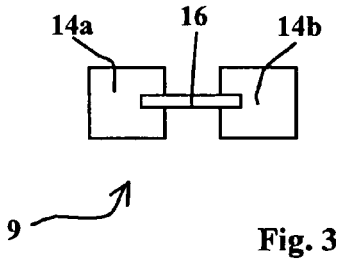
FIG. 3*b* is a schematic view of a resistor bridge implemented in another embodiment of the ignition device according to the invention.

FIGS. 3*a* and 3*b* show enlarged illustrations of two different embodiments of such ignition means 9. FIG. 3*a* thus shows ignition means 9 comprising a bridge 15 of a semiconductor material which is placed between two contact studs 14 of a conductor material. The semiconductor bridge will, for example, be made of doped silicon and the contact studs of copper.

The contact studs are of a width opposite the bridge which is less than their width at a distance from the bridge. Such an arrangement facilitates the priming of the ignition plasma between the studs.

Such a semiconductor bridge is well known to the Expert. Reference may be made, for example, to patent EP0711400 which describes an igniter using a semiconductor bridge.

When a specific electrical voltage (depending on the dimensional and physical characteristics of the material used to make the bridge 15) is applied between the contact studs 14, a plasma is generated through the bridge 15 and the resulting energy ensures the ignition of the detonating composition in contact with the bridge.

FIG. 3*b* shows another embodiment of ignition means 9. In this embodiment, the studs 14 are connected by a resistor conductor element 16 (made, for example, of gold). In this embodiment (also well known to the Expert) it is the heating by Joule effect of the resistor element 16 (or its explosion) which ensures 7410 the ignition of the detonating composition.

According to a preferred embodiment, the different ignition means 9 will be applied to the support 8 using the same technology as for the production of integrated circuits.

It is, in fact, quite conventional to use this technique to make a plurality of ignition means (using semiconductor or resistor bridges) on the same support, such means being thereafter cut, for example, by laser to be integrated individually, each in its own case.

In accordance with the invention, this technique will be used to make a support carrying all the ignition means (following specific geometric spacing which will be described hereafter) as well as the conductors (or conductor strips) which ensure (via the connector 10) the linking of the ignition means 9 to a power source incorporated in the control means 11.

The support 8 may thus be constituted by a disc of amorphous silicon on which the ignition means as well as the conductor strips will be made by metallization and/or vacuum deposition.

FIG. 4 shows that the support 8 carries axial ignition means 9*a* and a first group 17 of ignition means 9 spaced in a peripheral crown 18 (here there are twenty four igniters 9 evenly spaced angularly around the peripheral crown 18).

The support 8 also supports a second group of ignition means 9 spaced over at least one diametral arm.

Here, there are two diametral arms 19*a* and 19*b* each incorporating six ignition means 9. Note that the ends of the diametral arms pass via the ignition means 9*b*, 9*c*, 9*d* and 9*e* which belong to the peripheral crown 18.

As may be seen in FIG. 4, an upper face of the support has conductor strips enabling the terminals of certain igniters to be linked to the connector 10.

Thus, all the ignition means incorporate a fist contact stud 14*a* which is connected to a common conductor C (all the studs connected to the common conductor are shown hatched on FIG. 4). This common circuit passes via stud 14*a* of ignition means 9*c* and comprises a peripheral circular conductor strip 20*a* as well as two other internal circular strips 20*b* and 20*c* coaxial to the first one. The common circuit also comprises a strip 21 linking the different circular strips 20*a*, 20*b* and 20*c* of the common circuit.

Furthermore, the upper face of the support 8 has other conductor strips enabling the second contact studs 14*b* of a certain number of separate ignition means 9 to be connected together.

Thus, there are several groups of igniters 9 linked together and able to be simultaneously initiated via specific control conductors.

There is thus a first control conductor S1 which ensures the initiation of axial ignition means 9*a*.

There is also a second control conductor $S2_a$ which ensures the initiation of a first crown 22 of four ignition means spaced on arms 19*a* and 19*b* and around the axial ignition means 9*a*. The terminals 14*b* of these igniters are all linked to one another by a portion of circular strip 25.

Similarly, there are control conductors $S2_b$ and $S2_c$ which ensure the initiation of two other crowns 23 and 24 of four ignition means spaced over arms l9*a* and 19*b* and around the axial ignition means 9*a*. The terminals 14*b* of these igniters are also linked together by a portion of circular strip, respectively 26 and 27.

There is lastly a third control conductor $S3_a$ which ensures the initiation of a sector 28 of ignition means 9 all located on the peripheral crown 18.

The device shown in FIG. 4 thus incorporates four sectors 28, 29, 30 and 31 on its peripheral crown which are delimited by arms 19*a* and 19*b*. Each sector incorporates five contiguous ignition means 9.

Each of these sectors is controlled by a specific control conductor (respectively $S3_a$, $S3_b$, $S3_c$ and $S3_d$). At each sector, the contact studs 14*b* of the igniters are all linked together by a portion of circular strip. These portions of strip are marked 32, 33, 34 and 35 on the Figure.

Lastly, as described previously, on the peripheral crown there are four isolated igniters 9*b*, 9*c*, 9*d* and 9*e* positioned at the ends of arms 19*a* and 19*b*. Each of these igniters is controlled by a specific control conductor $Si_b$, $Si_c$, $Si_d$ and $Si_e$.

All the control conductors are linked to the connector 10 which thus comprises at least 13 prongs.

These connections are shown schematically in FIG. 4 by dashes and arrows leading to the connector 10 shown as a simple rectangle.

In practical terms, the connections are made in the form of strips carried by the other face of the support 8 and the connector is also carried by the other face and is placed at the centre of the support.

Figure 3C:
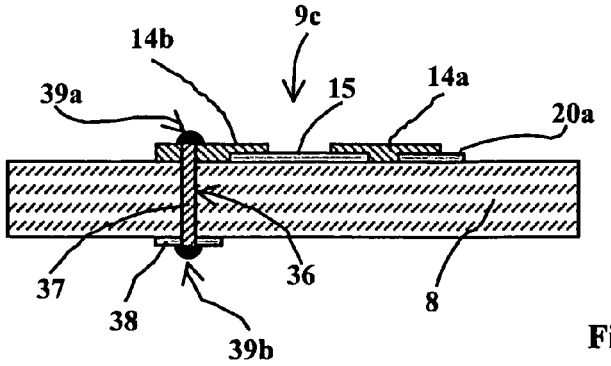
FIG. 3*c* is a partial cross section of the support for an ignition means.

Double face circuit technology is well known to somebody skilled in the art. By way of illustration, FIG. 3*c* shows the support sectioned at ignition means 9*c*. Studs 14*a* and 14*b* partially cover the bridge 15, as may be seen. Stud 14*a*, which is connected to the common circuit C, covers a metallic deposit which constitutes the circular strip 20*a*, positioned on the support 8 on the same side as the ignition means.

A drill hole 36 goes through the support 8. It enables the support's two faces to be linked. This drill hole, or plated through hole as it is termed by the Expert, is filled by a metallic deposit 37 connected by a weld 39*a* to contact stud 14*b* and by a weld 39*b* to a conductor strip 38 carried by the lower face of the support 8 and which leads to the connector 10.

The Expert will easily define the geometry of the strips which, made on the lower face of the support, will enable the different control circuits S of the connector 10 to be linked. Thus, in each of the groups of ignition means carried by the upper face of the support, a drill hole merely has to be made through the support 8 at one of the contact studs 14*b* of one of the ignition means in the group in question. Furthermore, another drill hole made at the contact stud 14*a* of ignition means 9*c* will ensure the passage of the common conductor C.

The electronic control means 11 have not been described in detail since they do not form the subject of the present invention. Classically, these control means are designed to send an electrical firing current between the common conductor C and one or several of the control conductors S1, S2, S3 . . . Si. The selection of the conductors to be powered will be made using programming and/or selection means suited to the mode of functioning operational needs of the warhead.

The different modes of functioning of the device according to the invention will now be described with reference to FIGS. 5*a*, 5*b*, 5*c* and 5*d*.

If the warhead 1 is required to be ignited so as to generate a slug, the axial priming of the explosive load 2 must be ensured.

Figure 5A:
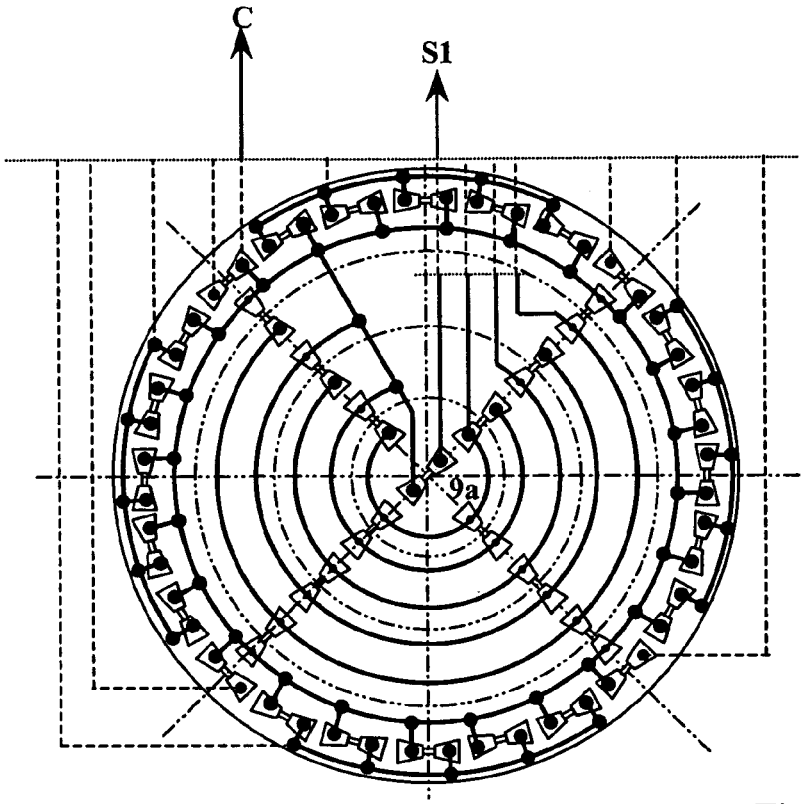
FIGS. 5*a*, 5*b*, 5*c* and 5*d* are views analogous to that in FIG. 4 but which schematize the electrical power supplies used to respectively ensure operation with central priming, annular priming, radial priming or priming by sector.

For this, the electronic control means sends a firing current only to ignition means 9*a*, thus between the common conductor C and the control conductor S1 (FIG. 5*a*).

Figure 5B:
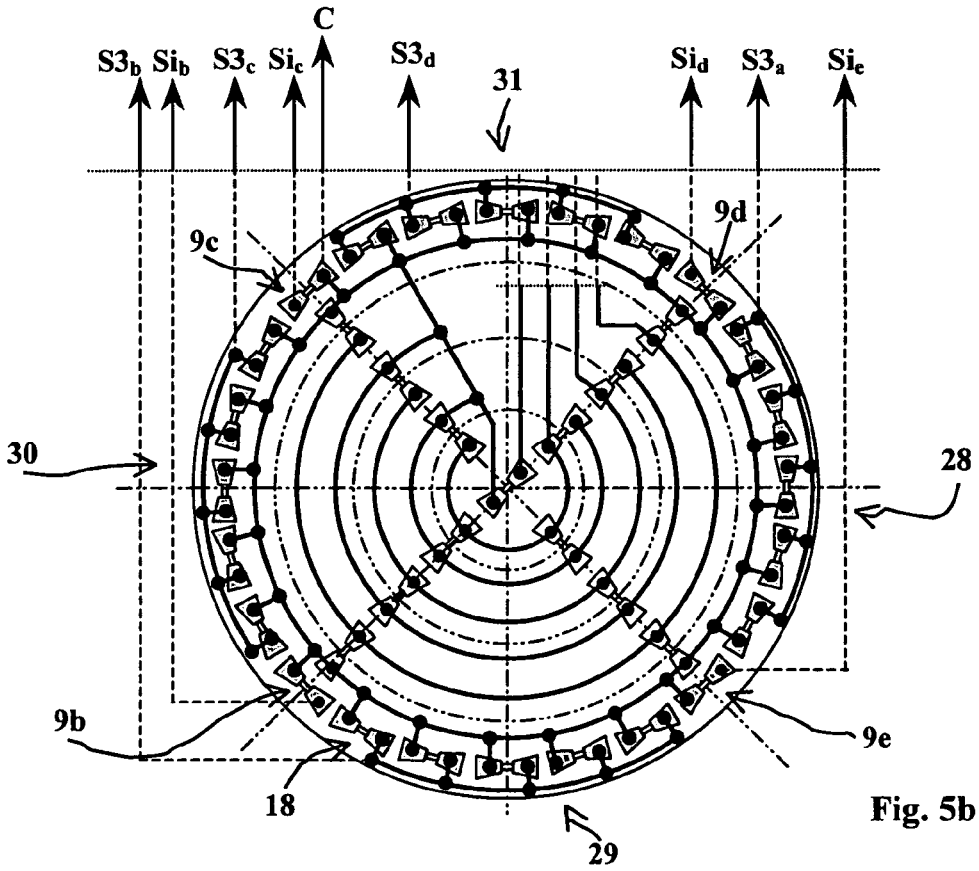

If the warhead is required to be ignited so as to generate a shaped charge dart, it is necessary for it to be ignited following a circular crown. FIG. 5*b* shows how it is possible for such a functioning to be initiated. For this, the electronic control means send a firing current between the common conductor C and all the control conductors $S3_a$, $S3_b$, $S3_c$ and $S3_d$ as well as all the isolated control conductors $Si_b$, $Si_c$, $Si_d$ and $Si_e$. Thus, all the ignition means 9 of the external crown 18 are ignited simultaneously, both those in groups 28, 29, 30 and 31 and those which are isolated 9*b*, 9*c*, 9*d* and 9*e*.

The ignition device described here incorporates twelve groups of ignition means each able to be activated separately. It is thus possible to obtain other modes of functioning for the warhead.

Figure 5C:
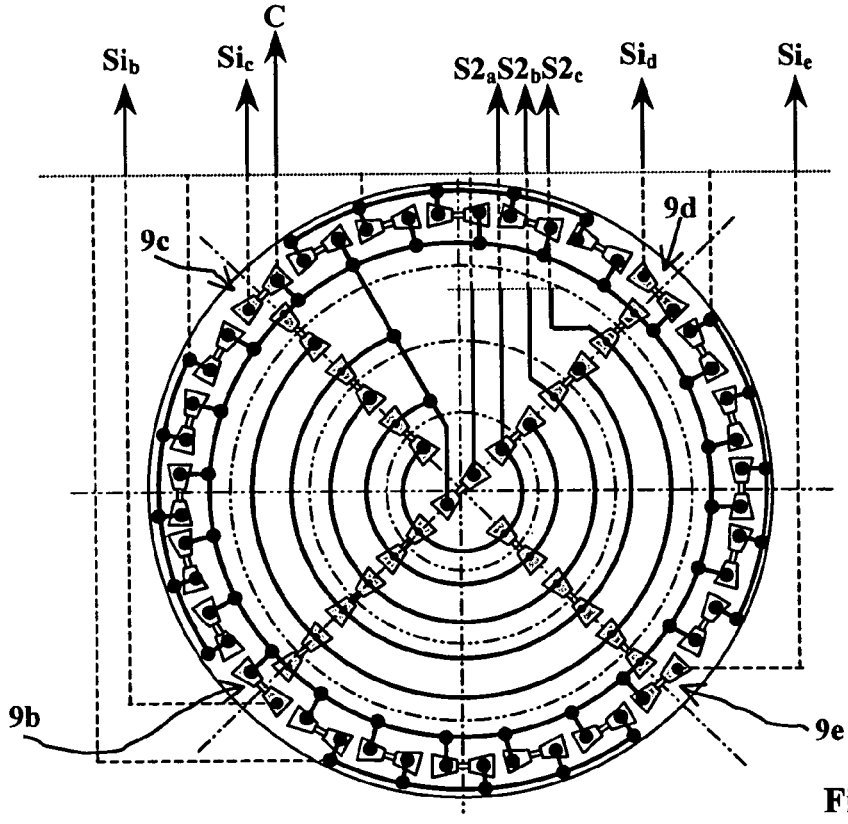

By way of example, FIG. 5*c* shows a mode of ignition in which all the ignition means spaced along arms 19*a* and 19*b* are controlled simultaneously, both isolated means 9*b*, 9*c*, 9*d* and 9*e* and those in crowns 22, 23 and 24.

Such a mode of ignition leads to the fragmentation of the liner and to the projection of these fragments in the direction of action DA of the charge (FIG. 1).

Figure 5D:
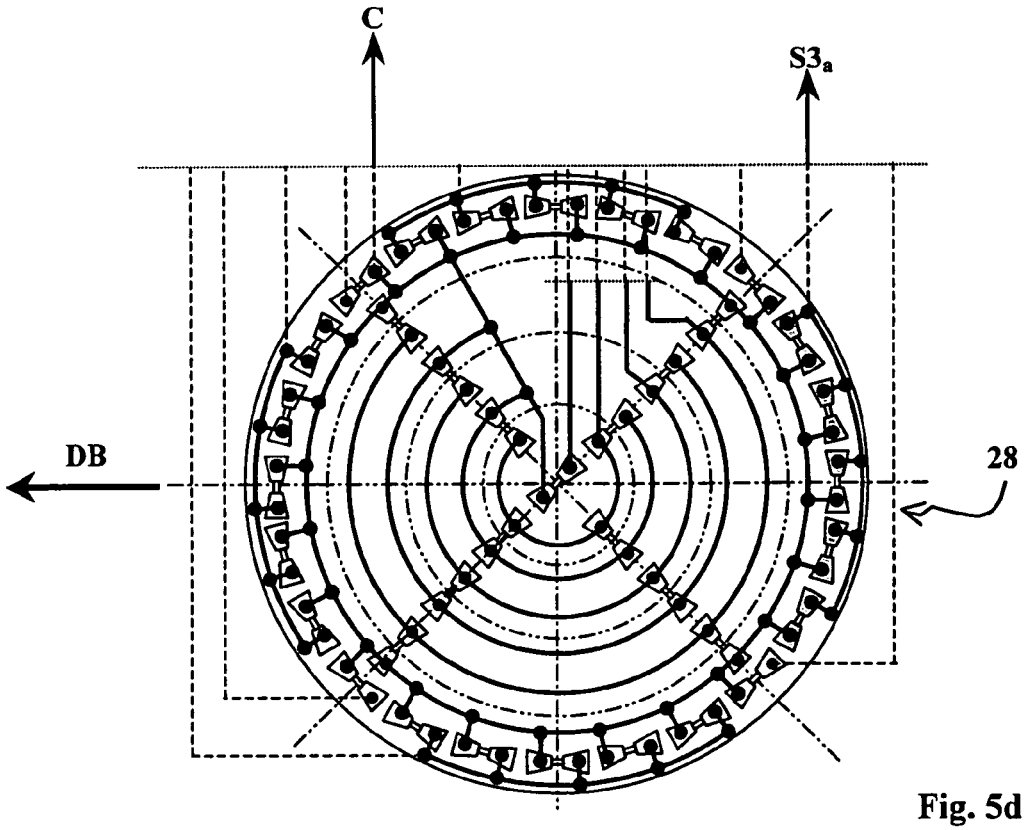

FIG. 5*d* shows a mode of ignition in which all the ignition means of sector 28 of the peripheral crown 18 are activated simultaneously. Such a mode of ignition leads to the projection of fragments of the casing 3 of the charge in a privileged direction DB that is substantially radial and opposed to the sector ignited.

As we can see, the device according to the invention enables means to be obtained simply which ensure the ignition of a multi-function warhead.

Indeed, the technologies implemented are those used to produce individual ignition means. It is no more costly to implement them to additionally ensure the production of all the conductor strips thereby obtaining a full component ensuring the required effects.

Furthermore, the positioning of the different ignition means with respect to one another is ensured in a reliable and reproducible manner by the device's simple design.

The support carrying its connector 10 is then simply set into place inside its case 6. The detonating composition 12 is loaded according to the usual loading procedures for igniters (or by bonding a plastic explosive sheet onto the support). Positioning accuracy for the ignition means with respect to the warhead casing is finally obtained by the single operation of fastening the case 6 onto the casing 3.

Furthermore, the axial volume of the device according to the invention is reduced. The height E may thus be less than 5 mm which enables extremely compact warheads to be produced.

Different variants are possible without departing from the scope of the invention. It is thus possible for ignition devices to be made that have a different number of ignition means or groups of ignition means.

Different spacing may thus also be defined for the ignition means.

It is thus also possible for a device to be made according to the invention in which the ignition means 9 are hot wire or exploded wire igniters. After manufacture of the support 8 carrying the conductor strips, it will thus be necessary for the wires to be welded between the contact studs of each igniter. Such a mode is, however, less advantageous since it is more costly to perform.

It is thus also possible, as mentioned in the preamble, to produce an ignition device according to the invention for gas-generating compositions.

The invention claimed is:

1. An ignition device for an explosive charge or pyrotechnic composition, comprising:

an electrically insulating support, at least two ignition means connected to said insulating support and to a power source, said ignition means comprising a plurality of conductive studs on a first surface of said insulating support, at least one pair of said studs connected to each other by a semiconductor or resistive bridge, and conductor means on said insulating support, connecting said ignition means to said power source, wherein the conductor means comprise conductive strips on the first surface of said insulating support.

2. An ignition device according to claim 1, wherein said ignition means comprise at least one semiconductor bridge.

3. An ignition device according to claim 1, wherein said device comprises a first group of said ignition means located along a peripheral arc of the first surface of said insulating support.

4. An ignition device according to claim 3, wherein said device comprises a second group of said ignition means located in a line segment along at least one diametral arm of the first surface of said insulating support.

5. An ignition device according to claim 4, wherein said ignition means are located along a peripheral arc and over two orthogonal diametral arms of the first surface of said insulating support.

6. An ignition device according to claim 1, wherein said ignition means comprise a first contact stud of said pair connected to a common conductor.

7. An ignition device according to claim 6, wherein said device comprises at least two control conductors, each of which is connected to second contact studs of two pairs of separate ignition means, such that the common conductor is connected to one stud of each pair and a control conductor is connected to the other stud of each pair.

8. An ignition device according to claim 7, wherein said device comprises at least a first control conductor ensuring the ignition of an axial ignition means.

9. An ignition device according to claim 7, wherein at least one of said other control conductors is for igniting a first arc of ignition means centered around said axial ignition means.

10. An ignition device according to claim 7, wherein said device comprises at least a third control conductor for igniting a sector of said ignition means along a peripheral arc of said insulation support.

11. An ignition device according to claim 10, wherein said peripheral arc comprises four sectors of said ignition means, each being separately ignitable by corresponding separate control conductors.

* * * * *